US005234367A

United States Patent [19]

DeCesare

[11] Patent Number: 5,234,367

[45] Date of Patent: Aug. 10, 1993

[54] ARTICULATED GLIDING RING

[76] Inventor: John J. DeCesare, 143 Ridgewood Ave., Glen Ridge, N.J. 07028

[21] Appl. No.: 871,269

[22] Filed: Apr. 20, 1992

[51] Int. Cl.[5] ..... A63H 27/00; A63H 33/00; A63B 65/00; A63B 65/10

[52] U.S. Cl. ..... 446/48; 446/34; 446/487; 273/425; 273/428

[58] Field of Search ..... 446/48, 47, 46, 34, 446/36, 236, 255, 266, 487, 488; 273/336, 424, 425, 426, 427, 428, 126 R, 285, 286

[56] References Cited

U.S. PATENT DOCUMENTS

| | | | |
|---|---|---|---|
| 207,346 | 8/1878 | Clow | 446/114 |
| 2,838,310 | 6/1958 | Redka | 273/426 |
| 4,027,389 | 6/1977 | Atchisson | 273/426 X |
| 4,114,307 | 9/1978 | Liebskind | 446/487 |
| 4,222,573 | 9/1980 | Adler | 273/426 |
| 4,560,358 | 12/1985 | Adler | 446/46 |
| 4,765,628 | 8/1988 | Jensen | 273/425 |
| 4,946,173 | 8/1990 | Schlegel et al. | 273/425 |

FOREIGN PATENT DOCUMENTS

| | | | |
|---|---|---|---|
| 0368815 | 5/1990 | European Pat. Off. | 446/487 |
| 285249 | 12/1913 | Fed. Rep. of Germany | 446/113 |

*Primary Examiner*—Robert A. Hafer
*Assistant Examiner*—D. Neal Muir
*Attorney, Agent, or Firm*—Howard E. Thompson, Jr.

[57] ABSTRACT

An articulated gliding ring is provided in which a plurality of elongated members, which may be curved or straight, are pivotally joined to form a closed ring of circular or polyhedric contour, each of the elongated members having, throughout the major portion of its length an airfoil contour. The articulated structure permits the gliding ring to be projected by back-hand delivery of the open ring, or over-hand delivery of the elongated ring grasped at one folded joint; and has the further advantage of permitting the ring to be folded to compact, pocket size for storage and transport. The most compact folding is made possible by disconnecting one of the pivot joints, and by employing straight rather than curved elongated members.

19 Claims, 3 Drawing Sheets

ARTICULATED GLIDING RING

This invention relates to an articulated gliding ring formed of a plurality of elongated airfoil components hingedly joined in end to end relation, whereby said ring can be collapsed to an elongated configuration for throwing purposes, but assumes a circular configuration in flight, permitting long glides characterized as having a relatively flat trajectory. The articulated ring is a versatile game or sport device which, inter alia can be utilized in much the same manner as "Frisbee" type gliding discs, but has the special advantage, by reason of its articulated structure of being foldable to compact pocket-sized configuration when not in use.

BACKGROUND OF THE INVENTION

The gliding ring art is rather highly developed as evidenced by U.S. Pat. No. 4,560,358 dated Dec. 24, 1985 for Gliding Ring, and the numerous prior patents referred to therein. A search in the Patent Office records, however, has failed to bring to light anything closely resembling the articulated gliding ring structure of the present invention. One patent was encountered showing means for converting a relatively large ring structure to a much more compact, storable ring structure by a unique twisting action. This is U.S. Pat. No. 4,832,652 dated May 23, 1989 for a Circular Foldable Toy, which is in a totally unrelated art. The ring member of this patent is neither intended or adapted to provide gliding characteristics.

THE INVENTION

It has now been discovered, in accordance with the present invention, that an extremely versatile gliding ring device can be provided by employing a plurality of elongated airfoil sections pivotally joined together in end to end relation to form a closed ring. The articulated structure permits the device to assume an essentially circular or ring configuration in flight, whether projected by a back hand delivery of the device while in open ring configuration, or by overhand delivery in which the device is flattened to elongated configuration, and grasped at one of the hinge joints. The articulated structure provides a special advantage of permitting the device to be folded upon itself to a pocket-sized configuration practical for storage or transport.

While it is preferable that the elongated components of the articulated structure be of such curvature as to form a circular configuration when extended, the device will have generally similar glide characteristics if straight members are used which, as extended, will form a polygon rather than a circle. It will be apparent that the dimensions of the collapsed folded device will be even smaller when fashioned from straight sections than when fashioned from curved sections so that, if compactness for storage is of prime concern, the use of the straight sections would be preferable.

With wither type construction the elongated members will be relatively flat, and throughout the major portion of their length will have an airfoil contour generally comparable to that of an airplane wing, with the edge which will be the outer edge when extended to circular configuration being rounded and somewhat thicker than an inner edge.

The opposed ends of the elongated members are fashioned to provide hinged joints between adjacent members, with portions overlapping to form the hinged joints, being flattened to maintain essential coplanar alignment of the assembled parts. The hinged joints can be provided in various ways, one approach being to provide each elongated member with a protruding lug at one end with a slightly divergent profile and a circular aperture at the other end, permitting snap engagement with the protruding lug of an adjacent member. With this approach, it is apparent that in the multi-membered device one needs a single fabricated element, because all elements can be joined together by the interengaging lugs and apertures to form the device.

There are other practical approaches, however. The elongated members can be fashioned with apertures at both ends, with the ends of adjacent members being joined by unitary rivet-like pivot members, or two-part interconnecting joints, as desired. It should be noted in this connection that the ability to open and close at least one joint is desirable from the standpoint of achieving maximum compactness for storage and transport of the device. In a device containing an odd number of elongated members, it is essential that at least one joint be capable of opening and closing in order to achieve compact folding of the elongated members.

In the mode of assembly above described each elongated member will have one end above and the other end below its adjacent members. An alternative mode of assembly in a ring having an even number of elongated members would be to have both ends of each elongated members either above or below adjacent members to create an alternative upper and lower orientation of the elongated members. While such a change will only slightly modify the gliding characteristics of the device, it will substantially modify the folding of the device when not in use, providing a broader but flatter configuration.

The number of elongated members forming the articulated gliding ring can be four or more. The optimum number is six for a ring of preferable size, suitably about 11 to 13 inches in outside diameter when extended. As the number of elongated members is reduced, the folded configuration becomes longer, and if increased, the folded configuration becomes thicker for a given outside diameter.

The elongated members forming the device can be molded from neoprene type rubber or from the various plastic materials which will provide a desired combination on integrity in form retention and slight resilience and flexibility. With some materials the complete elongated member, with aperture at one end and protruding lug at the other can be formed in a single molding operation, with the material itself providing adequate strength in the protruding lug and sufficient resilience in its enlarged end to permit locking interengagement with the aperture of an adjacent member. In order to provide greater durability it can be desirable to include a preformed reinforcing core with apertures at both ends, and fashioned from light weight metal or from plastic material having more rigid characteristics than the primary molding material.

In a gliding ring in accordance with the present invention that is approximately 12 inches in diameter, the approximate dimensions in the elongated members will be about 1⅛ inches from the outer leading edge to the trailing edge, with a thickness of approximately ¼ inch in areas close to the leading edge, and approximately 1/16 inch at the trailing edge, with both leading and trailing edges being smoothly rounded. With a ring so constructed, an experienced user can project the ring quite accurately to targets 50 to 100 yards distant, with the ring following a flat trajectory during the long glide. A ring so projected can be easily caught by an individual in the target range, or by a projecting target peg, in a game which might be considered as an extended version of "quoits".

If a more durable ring is desired, or one which can be more comfortably caught by a hand entering the ring opening, and engage an inner trailing edge of the airfoil, one can increase the thickness of the trailing edge to provide an airfoil of generally uniform thickness, but slightly domed between the two edges. Alternatively, one can increase the overall thickness of a tapered airfoil, as by providing a thickness of approximately ⅜" adjacent the leading edge, and approximately 3/16" adjacent the trailing edge. With either such modification, the ring will still have excellent flight characteristics, although with somewhat shorter range, unless more force is used in delivery.

BRIEF DESCRIPTION OF THE DRAWINGS

Novel features of the articulated gliding ring of the present invention will be more fully understood from a consideration of the accompanying drawings in which various parts are identified by suitable reference characters in the several views and in which.

DESCRIPTION OF PREFERRED EMBODIMENTS

Figure 1:
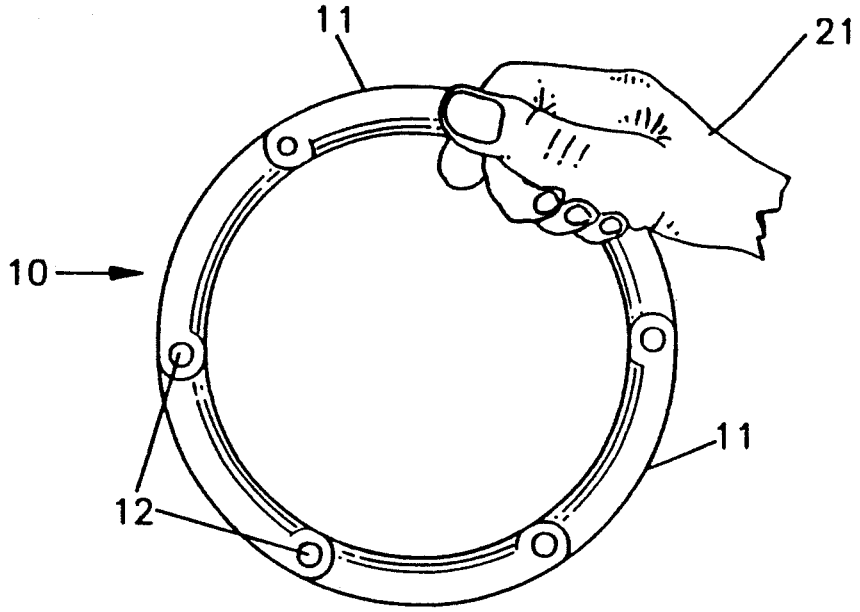
FIG. 1 is a plan view of an articulated gliding ring in extended circular configuration, as held for back-hand projection.
Figure 2:
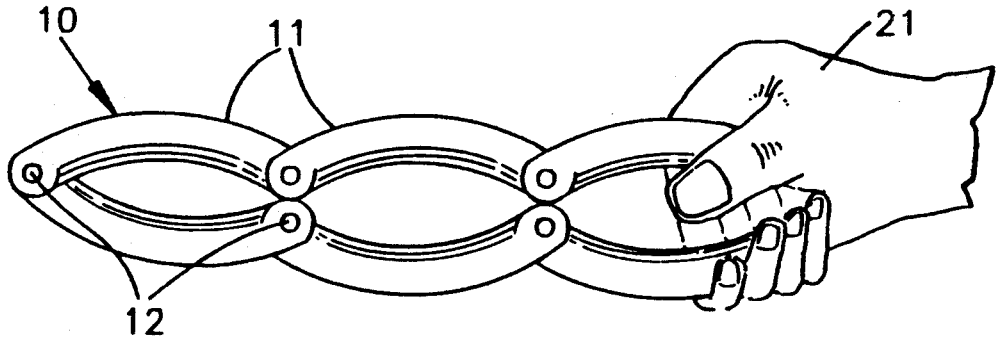
FIG. 2 is a plan view of the articulated gliding ring in elongated configuration, as held for over-hand projection.
Figure 3:
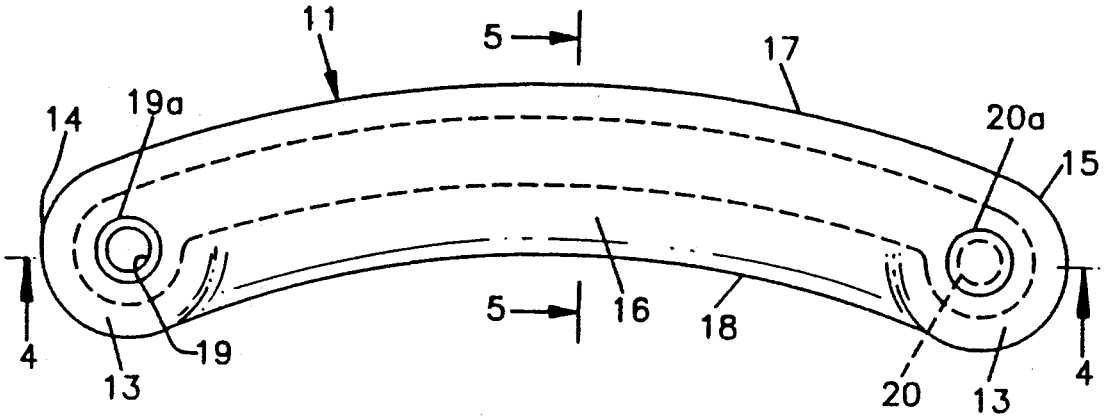
FIG. 3 is a plan view of a single elongated member of the articulated gliding ring shown in FIGS. 1 and 2.
Figure 4:
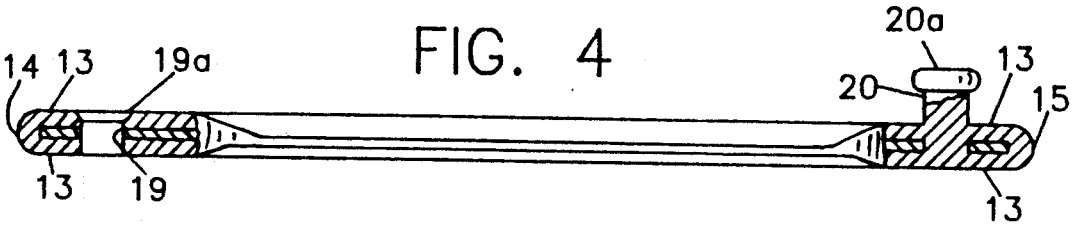
FIG. 4 is an edge view of the elongated member taken in the direction of the arrows 4, 4 in FIG. 3, and with part of the structure broken away and in section.

As shown in the drawings the novel articulated gliding ring 10 comprises a plurality of elongated members 11 arranged in end to end relation to form a closed ring and with overlapping ends hingedly coupled as seen at 12 in FIGS. 1 and 2.

The elongated members 11 as more clearly illustrated in FIGS. 3 to 6 are relatively flat members, having parallel upper and lower bearing surfaces 13 at ends 14, 15, and a main airfoil portion 16, having a thicker configuration adjacent the outer leading edge 17, and much thinner configuration adjacent the inner trailing edge 18.

Centrally of end 14 is an aperture 19, flared at its upper portion as seen at **19*a*; and centrally of the end 15 is a protruding lug 20 with an end enlargement 20*a* of a size to have close, detachable engagement with the aperture 19, 19*a* of an adjacent member 11. Interengagement of lugs 20 and apertures 19 on adjacent member 11 provide the hinged couplings 12** of the articulated device.

Figure 5:
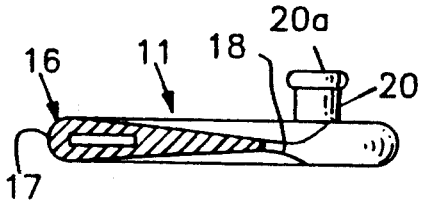
FIG. 5 is a sectional and background view taken on the line 5, 5 of FIG. 3.
Figure 6:
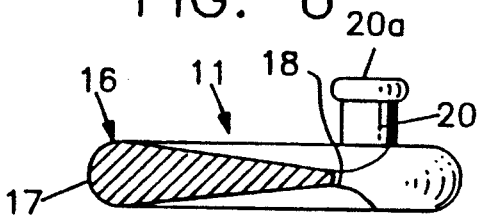
FIG. 6 is a view similar to FIG. 5, illustrating a modified construction.

The airfoil contours shown in FIGS. 5 and 6 must be understood as generally illustrative of the considerable variation possible in airfoil design. The configuration shown in in FIG. 5 provides good gliding performance in a light weight articulated ring construction in which the elongated members 11 are relatively thin. The FIG. 6 illustration, on the other hand, is illustrative of a sturdier ring construction in which the elongated member 11 is substantially thicker, with the airfoil 16 being correspondingly thicker at both the leading and trailing edges. The configuration in FIG. 6 provides good gliding stability; but a ring of this sturdier construction will require substantially greater projective force to attain the glide distances easily reached with the lighter device as shown in FIG. 5.

Projection of the articulated glide ring is preferably accomplished by grasping the extended ring, preferably positioning the hand 21 at one of the hinge joints 12, as shown in FIG. 1, and with a rapid back-hand movement projecting the ring toward a target area, while at the same time, guiding the path of desired trajectory. This mode of delivery facilitates maximum accuracy in delivering the gliding ring to a desired target area.

The articulated structure permits an alternative type of delivery in which the articulated ring is elongated, as shown in FIG. 2, grasped by the hand 21 at one end of the elongated configuration, and delivered by a rapid over-hand movement of the arm. Because of centrifugal force in portions of the extended ring remote from the hand 21 this is a more powerful delivery, making possible longer glides than normally accomplished by the back-hand delivery. As it leaves the hand, the elongated ring configuration of FIG. 2 rapidly assumes in flight the circular configuration of FIG. 1, generally accomplishing this within the first 5 to 10 yards of flight.

Figure 7:
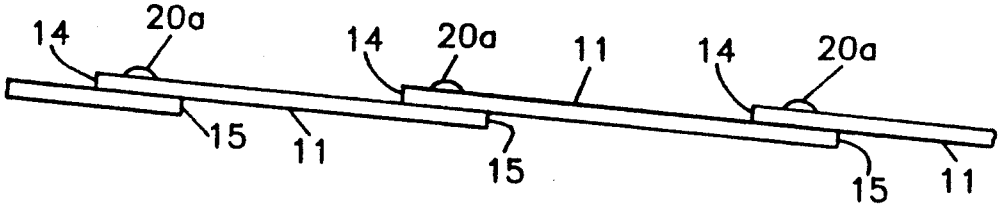
FIG. 7 is a partial diagramatic view illustrating one mode of assembly of elongated members in the articulated gliding ring.

With the over-hand delivery it is somewhat more difficult to accurately aim the ring at a particular target area, although with practice and skill in adjusting hand FIG. 7 is a diagramatic illustration of the assemblage with elongated members 11 in the device as shown in FIGS. 1 and 2, with apertured end 14 of each member 11 fitting over the lug 20, **20*a* of end 15 of the adjacent member 11**.

Figure 8:
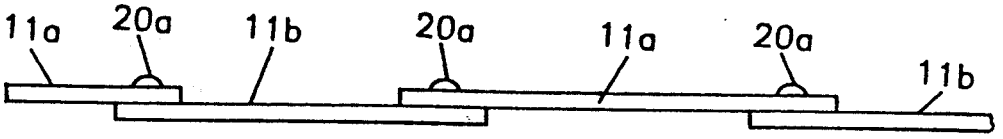
FIG. 8 is a view similar to FIG. 7 illustrating another mode of assembly.

FIG. 8 is a view similar to FIG. 7 in which the elongated members are in two forms, those identified as **11*a*, having apertures at both ends, and those identified as 11*b*, having lugs 20, 20*a* at both ends. This mode of assembling, which can be used in a gliding ring having an even number of elongated members, provides an articulated gliding ring having flight characteristics quite similar to those assembled in the manner shown in FIG. 7. The FIG. 7** configuration, however, permits a more compact folding of the device when not in use.

Figure 9:
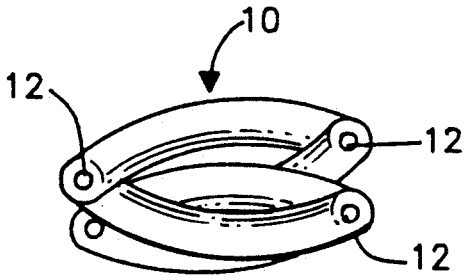
FIG. 9 is a plan view of the articulated gliding ring shown in FIGS. 1 and 2 as collapsed for storage with all hinge joints remaining connected.
Figure 10:
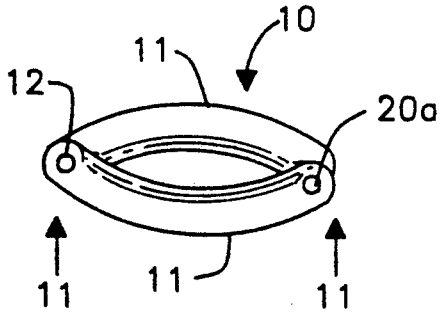
FIG. 10 is a view similar to FIG. 9 illustrating the more compact storage configuration possible when one hinge joint is disconnected.
Figure 11:
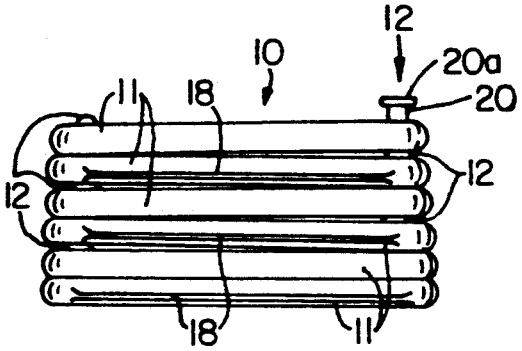
FIG. 11 is a side elevation view taken in the direction of the arrows 11, 11 in FIG. 10.

FIGS. 9 to 11 are presented to illustrate the compact folding of the device 10, as shown in FIGS. 1 and 2. The FIG. 9 illustration shows the configuration of the folded device when all of the joints 12 remain connected, whereas FIGS. 10 and 11 show respectively the plan view and side elevation of the more compact configuration which is possible when one of the joints 12 is disconnected, as evidenced by the exposed lug 20, 20*a*, as seen in FIG. 11.

Figure 12:
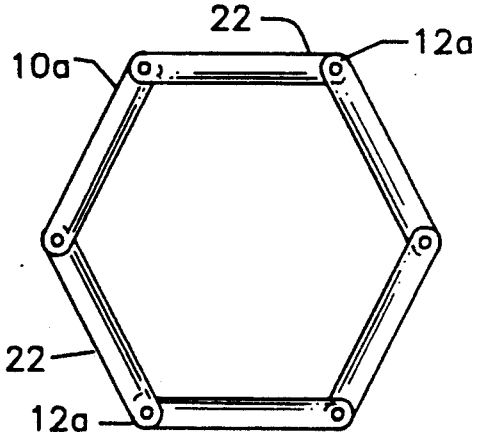
FIG. 12 is a view similar to FIG. 1 showing the articulated gliding ring as fashioned from straight sections rather than curved sections.

FIG. 12 is a view similar to FIG. 1 in which the ring 10*a* has elongated straight members 22 substituted for the elongated arcuate members of FIG. 1, and pivotally coupled together in end to end relation as seen at 12*a*. Except for being straight instead of curved, the elongated members 22 will incorporate all of the structural features and modifications applicable to the elongated members 11 in describing FIGS. 3 to 8.

A gliding ring having the polygon configuration of FIG. 10 will have flight characteristics quite similar to the circular ring shown in FIG. 1, but will be somewhat more sluggish due to the irregular periphery as the device is rotated, producing a type of air resistance not experienced with the circular device.

Note, however, that with the polygon configuration of FIG. 12, and when one of the joints 12*a*, is disconnected, the folded configuration will be even more compact than that shown in FIG. 10 because all of the elongated members 22 will be aligned one above the other, and the width of the members 22 becomes the width of the folded assemblage.

FIGS. 13 to 16 are presented to illustrate typical ways of securing an upper elongated member 11*a* to a lower elongated member 11*b*. While in these views the pivot bearing has been shown as a separate part, it is to be understood that in each instance the pivot bearing can be an integral molded portion or implant embedded in the lower elongated member 11*b*.

Figure 13:
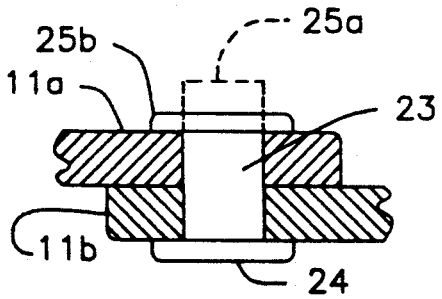
FIGS. 13 to 16 are sectional views illustrating typical permanent and detachable pivot couplings for use in assembling the articulated gliding ring.

In FIG. 13 the pivot bearing 23 with enlarged head 24 at its lower end is fashioned from plastic or deformable metal to initially have the dotted line configuration 25*a*, but deformable to provide retaining enlargement 25*b* engaging the outer surface of elongated member 11*a*.

Figure 14:
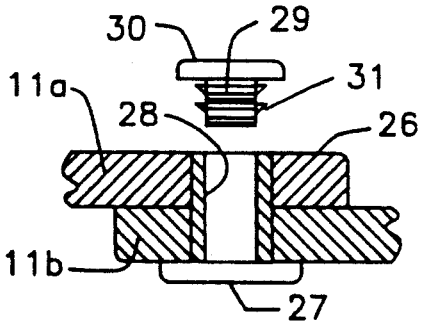

In FIG. 14 a cylindrical bearing member 26 has an enlarged lower end 27 and a central recess 28 for receiving a cylindrical plug 29, with an enlarged head 30, and radial protrusions 31 for interlocking engagment with inner surfaces of the recess 28.

Coupling means of the type shown in FIGS. 13 or 14 can be used for all of the pivot couplings 12, 12*a* when no detachment of a pivot coupling is desired for storage purposes. One way to provide for pivot coupling disengagement is to employ in the pivot coupling the type of stud 20, 20*a* interfitting with aperture 19, 19*a* as discussed in connection with FIGS. 3 to 6. Alternative detachable couplings are depicted, however, in FIGS. 15 and 16.

Figure 15:
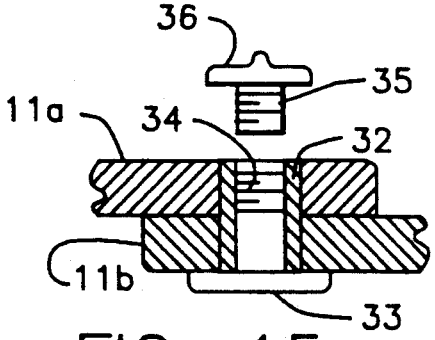

In FIG. 15 a tubular bearing member 32 with enlarged head 33 and internal threads 34 interfits with an externally threaded stud 35, having an enlarged head 36 for engagement with the upper elongated member 11*a*.

Figure 16:
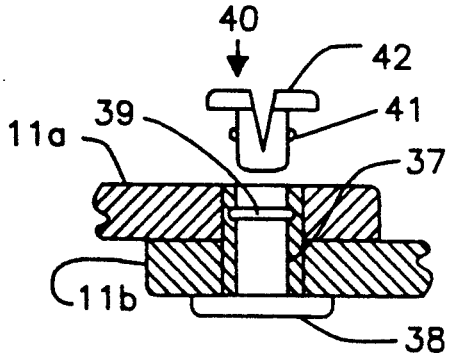

In FIG. 16 a bearing member 37 with enlarged head 38 has a central recess with lateral offset 39 engaged by a spring plug 40, having lateral offset 41 for locking engagement with the lateral offset 39 when the enlarged head 42 is in engagement with upper elongated member 11*a*. It will be apparent that disengagement of this fastener is accomplished by pushing together (against the spring action) the two sides of the enlarged head 42.

The approach to provide pivotal coupling of the elongated members utilized in the articulated flying ring which is considered preferable is the molding of the elongated members 11, 22 in a manner to precisely form the apertures 19, 19*a* and the bearing projections 20, 20*a* as shown in FIGS. 3 to 6 with sufficient precision to proide a snap engagement which will normally support the parts in assembled relation, while at the same time permit forcible disengagement of any joint, if desired.

Various changes and modifications in the articulated gliding ring as herein described may occur to those skilled in the art, and to the extent that such changes and modifications are embraced by the appended claims, it is to be understood that they are a substitute part of the present invention.

I claim:

1. An articulated gliding ring comprising four or more elongated members joined at their overlapping ends by freely rotatable pivot means to form a closed ring, said pivot means loose enough to allow reconfiguration of said ring while in flight said overlapping ends having flat bearing surfaces providing planar stability to the assemblage as extended to ring formation, the major portion of each elongated member, between said overlapping ends, having a transverse airfoil contour, said contour comprising an outer thicker edge and an inner thinner edge with a curved upper surface and a curved lower surface said articulated structure providing the versatility of permitting glide projection by back-hand delivery when in ring configuration, or by over-hand delivery when in flattened configuration and grasped by one folded joint, and permitting folding to compact, pocket sized configuration for storage and transport purposes.

2. An articulated gliding ring as defined in claim 1, wherein said elongated members are molded from plastic material having resilient, form retaining properties.

3. An articulated gliding ring as defined in claim 2, wherein said elongated members have embedded in said plastic material reinforcing cores fashioned from more rigid material, said cores being elongated flat members having enlarged circular ends with central apertures forming part of said pivot means, and said circular ends being offset to one side of said flat core members.

4. An articulated gliding ring as defined in claim 1, wherein the number of elongated members is in the range of 4 to 8.

5. An articulated gliding ring as defined in claim 1, wherein six elongated members are employed.

6. An articulated gliding ring as defined in claim 1, wherein said ring contains an even number of elongated members and the pivot means serves to permanently secure together said elongated members.

7. An articulated gliding ring as defined in claim 1, wherein at least one pivot means is of detachable nature.

8. An articulated gliding ring as defined in claim 1, wherein the ring diameter is about 12 inches, the elongated members have a width from leading edge to trailing edge of about 1⅛ inches and an airfoil contour tapering from at least ¼ inch thick adjacent the leading edge to at least 1/16 inch adjacent the trailing edge.

9. An articulated gliding ring as defined in claim 8 wherein a sturdier ring construction is provided by enlarging the airfoil contour to about ⅜ inch adjacent the leading edge, and about 3/16 inch adjacent the trailing edge.

10. An articulated gliding ring as defined in claim 1, wherein said pivit means comprises a bearing portion protruding from the end of one elongated member passing through an aperture in the overlapping end of an adjacent elongated member, with laterally projecting means at the end of said bearing portion for retaining said apertured end against displacement.

11. An articulated gliding ring as defined in claim 10, wherein said bearing portion is formed of, or permanently embedded in material of the elongated member from which it protrudes.

12. An articulated gliding ring as defined in claim 10, wherein said bearing portion comprises an independent member passing through apertures in overlapping ends of two adjacent elongated members.

13. An articulated gliding ring as defined in claim 10, wherein said bearing portion is fashioned from a deformable material which is offset after assembly to provide said laterally projecting retaining means.

14. An articulated gliding ring as defined in claim 10, wherein said bearing portion is of tubular configuration, and a part interfitting therewith having a lateral extension for bearing against and retaining the apertured end of the overlapping elongated member.

15. An articulated gliding ring as defined in claim 14, wherein said interfitting part has laterally extending grippers for interlocking engagement with inner surfaces of said tubular configuration.

16. An articulated gliding ring as defined in claim 14, wherein said interfitting part is externally threaded to engage internal threads within said tubular configuration.

17. An articulated gliding ring as defined in claim 14, wherein said interfitting part is an elongated generally cylindrical member having lateral protrusions for interlocking engagement with inner surfaces of said tubular configuration, and having an axial V-shaped cut through a major portion of its length, imparting spring properties to said interfitting part, whereby detachment thereof is accomplished by applying radial compression to opposing portions of said lateral extensions bearing against the apertured elongated member.

18. An articulated gliding ring as defined in claim 10, wherein each elongated member has a bearing portion at one end, and an aperture at the other.

19. An articulated gliding ring as defined in claim 10, wherein the ring employs two types of elongated members, one type having protruding bearing portions at both ends, and the other type having apertures at both ends.

* * * * *